US009159304B1

(12) United States Patent
Tseng

(10) Patent No.: US 9,159,304 B1
(45) Date of Patent: Oct. 13, 2015

(54) BORE-VARIABLE LEADPIPE FOR BRASS INSTRUMENTS

(71) Applicant: K.H.S. Musical Instrument Co., Ltd., New Taipei (TW)

(72) Inventor: Shih Hao Tseng, Pingtung County (TW)

(73) Assignee: K.H.S. MUSICAL INSTRUMENT CO., LTD., New Taipei (TW)

( * ) Notice: Subject to any disclaimer, the term of this patent is extended or adjusted under 35 U.S.C. 154(b) by 56 days.

(21) Appl. No.: 14/221,636

(22) Filed: Mar. 21, 2014

(51) Int. Cl.
*G10D 9/02* (2006.01)

(52) U.S. Cl.
CPC ..... *G10D 9/02* (2013.01)

(58) Field of Classification Search
CPC ..... G10D 7/10; G10D 9/00; G10D 9/02; G10D 9/043; G10D 7/08; G10D 9/04; G10G 5/00
USPC ..... 84/380 R, 387 R, 387 A
See application file for complete search history.

(56) References Cited

U.S. PATENT DOCUMENTS 4,273,020 A * 6/1981 Happe ..... 84/394
8,324,491 B1 * 12/2012 Malluck ..... 84/387 R

* cited by examiner

*Primary Examiner* — Kimberly Lockett
(74) *Attorney, Agent, or Firm* — Rabin & Berdo, P.C.

(57) ABSTRACT

A bore-variable leadpipe includes a mouthpiece receiver integrally formed on a tube body of a brass instrument and a mouthpiece adaptor detachably assembled to the mouthpiece receiver. The mouthpiece receiver internally defines a first bore, in which an assembling section, a tapered section and an air-guiding section are sequentially formed. The mouthpiece adaptor has a receiving end for receiving a mouthpiece therein and an assembling end for engaging with the assembling section, and internally defines a second bore between the two ends. When the mouthpiece adaptor is assembled to the mouthpiece receiver, the second and the first bore are aligned and communicable with each other to form a conical passage and a cylindrical passage. The leadpipe can be changed in its bore size by assembling a mouthpiece adaptor of a different bore size to the mouthpiece receiver, so that the same brass instrument can be used with differently sized mouthpieces.

8 Claims, 8 Drawing Sheets

BORE-VARIABLE LEADPIPE FOR BRASS INSTRUMENTS

FIELD OF THE INVENTION

The present invention relates to a leadpipe for brass instruments, and more particularly to a bore-variable leadpipe that can be quickly disassembled and assembled again to change a bore size thereof, so that mouthpieces of different sizes for euphonium, baritone and so on can be used with the same type of brass instrument via the bore-variable leadpipe.

BACKGROUND OF THE INVENTION

Wind instruments are musical instruments that include a hollow tube body serving as a resonator. According to different sounding principles thereof, the wind instruments are divided into two major types, namely, brass instruments and woodwind instruments. A brass instrument produces sound when a player blows into a mouthpiece set at the end of the resonator to vibrate a column of air in the resonator. Some very common brass instruments include trumpets, French horns, trombones, euphoniums and baritones.

Please refer to FIG. 1. Any type of brass instrument generally includes a mouthpiece 10, a leadpipe 11, a mouthpipe 12, a valve section 13 and a bell 14. The mouthpiece 10 includes a funnel-shaped or bowl-shaped cup 101 and a tapered shank 102 extended into the leadpipe 11. The valve section 13 is located between the mouthpipe 12 and the bell 14 and generally includes three to six valves. In most cases, three or four valves are arranged in the valve section 13.

Conventionally, the leadpipe 11 for a brass instrument has an opening formed into a conical bore 111, a size of which is depending on the type of the musical instrument and is usually fixed for receiving a correspondingly sized shank 102 therein. Therefore, to play different brass instruments, a brass player has to own not only a number of brass instruments, but also a number of differently sized mouthpieces 10 to produce sound.

This means the brass player has to purchase different types of brass instrument as well as differently sized mouthpieces, and the cost thereof doubtlessly forms a considerable burden to the brass player. Some brass instruments have a leadpipe bore that can only receive a small-size mouthpiece. For a brass player who prefers to a large-size mouthpiece for playing the brass instruments, the use of a mouthpiece having the player's preferred size to play different brass instruments without being limited to the mouthpiece sizes specific to individual brass instruments would no doubt help the player to get adapted to different brass instruments more quickly.

In view that the conventional brass instruments respectively have a leadpipe that can be used with only one type of mouthpiece, it is desirable to develop a bore-variable leadpipe to allow easy change of the bore size of the leadpipe of a brass instrument, so as to overcome the drawback in the conventional leadpipe.

SUMMARY OF THE INVENTION

A primary object of the present invention is to provide a bore-variable leadpipe for brass instruments, so that any type of brass instrument can be played with a differently sized mouthpiece that is originally designed for a different type of brass instrument, such as euphonium or baritone.

Another object of the present invention is to provide a bore-variable leadpipe, of which the design concept can be applied to any type of brass instrument, allowing a brass player to play different types of brass instruments with the same one mouthpiece and making the brass instruments more convenient to play.

A further object of the present invention is to provide a two-part leadpipe that includes a fixed mouthpiece receiver and a changeable mouthpiece adaptor, allowing a brass player to easily change the bore size of the leadpipe by assembling a mouthpiece adaptor having a required bore size to the mouthpiece receiver and therefore making the brass instruments more convenient for use.

To achieve the above and other objects, the bore-variable leadpipe according to the present invention is connected to a brass instrument and allows a mouthpiece to fit therein, and includes a mouthpiece receiver and a mouthpiece adaptor that are detachably assembled to each other.

According to a first embodiment of the bore-variable leadpipe of the present invention, the mouthpiece receiver is integrally formed on a tube body of the brass instrument and internally defines a first bore that extends from a first opening of the mouthpiece receiver toward the tube body of the brass instrument. And, an assembling section, a tapered section and an air-guiding section are sequentially formed in the first bore starting from the first opening.

In the first embodiment, the mouthpiece adaptor of the bore-variable leadpipe has a receiving end, through which the mouthpiece is extended into the mouthpiece adaptor, and an assembling end for extending into the first bore to engage with the assembling section and thereby assembling the mouthpiece adaptor to the mouthpiece receiver. The receiving end and the assembling end define a second opening and a third opening, respectively; and the mouthpiece adaptor internally defines a second bore that communicates the second opening with the third opening.

The second bore and the first bore are aligned and communicable with each other when the mouthpiece adaptor is assembled to the mouthpiece receiver, and thereby together form a conical passage, in which the mouthpiece is fitted, and a cylindrical passage, via which air is guided to the tube body of the brass instrument. In the first embodiment, a size of the second bore at the third opening is the same as that of the first bore at the tapered section; and the mouthpiece is fixedly fitted in the conical passage formed by the aligned first bore and second bore.

According to a second embodiment of the bore-variable leadpipe of the present invention, the mouthpiece receiver is structurally identical to that in the first embodiment, and the mouthpiece adaptor also has a receiving end, through which the mouthpiece is extended into the mouthpiece adaptor, and an assembling end for extending into the first bore. However, the mouthpiece adaptor in the second embodiment further includes an extended tube portion outward extended from the assembling end for changing the size of the second bore at the third opening. And, the extended tube portion has an outer surface fitly contacting with an inner surface of the tapered section when the mouthpiece adaptor is extended into the first bore.

The second bore and the first bore are aligned and communicable with each other when the mouthpiece adaptor is assembled to the mouthpiece receiver, and thereby form a conical passage, in which the mouthpiece is fitted, and a cylindrical passage, via which air is guided to the tube body of the brass instrument. In the second embodiment, the size of the second bore at the third opening is the same as that of the first bore at the air-guiding section; and the mouthpiece is fixedly fitted in the conical passage that is formed by the second bore alone.

In both of the first and second embodiments, the mouthpiece receiver further internally includes a shoulder portion formed on around a junction between the assembling section and the tapered section, and the mouthpiece adaptor includes at least one shoulder portion formed on around an outer surface of the mouthpiece adaptor between the receiving end and the assembling end; further, the assembling end of the mouthpiece adaptor and the assembling section of the mouthpiece receiver can be connected to each other in different manners, including but not limited to the engagement of male threads or at least one slide block formed on the assembling end with female threads or at least one guide groove formed in the assembling section.

The bore-variable leadpipe of the present invention is characterized by including a fixed mouthpiece receiver integrally formed on the tube body of a brass instrument and a changeable mouthpiece adaptor detachably assembled to the mouthpiece receiver. Therefore, a brass instrument player may change the bore size of the leadpipe by assembling a mouthpiece adaptor having a desired bore size to the mouthpiece receiver, and mouthpieces of different sizes can be used with the same brass instrument via the bore-variable leadpipe.

It is noted the design concept of the bore-variable leadpipe of the present invention can be applied to any type of brass instrument. With the bore-variable leadpipe, a brass player can use the same mouthpiece with different brass instruments or use different mouthpieces with the same brass instrument. Moreover, the mouthpiece adaptor of the bore-variable leadpipe of the present invention can be easily disassembled from the mouthpiece receiver and replaced with another one to enable quick change of the bore size of the leadpipe. In this manner, the brass instruments are more convenient for use.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
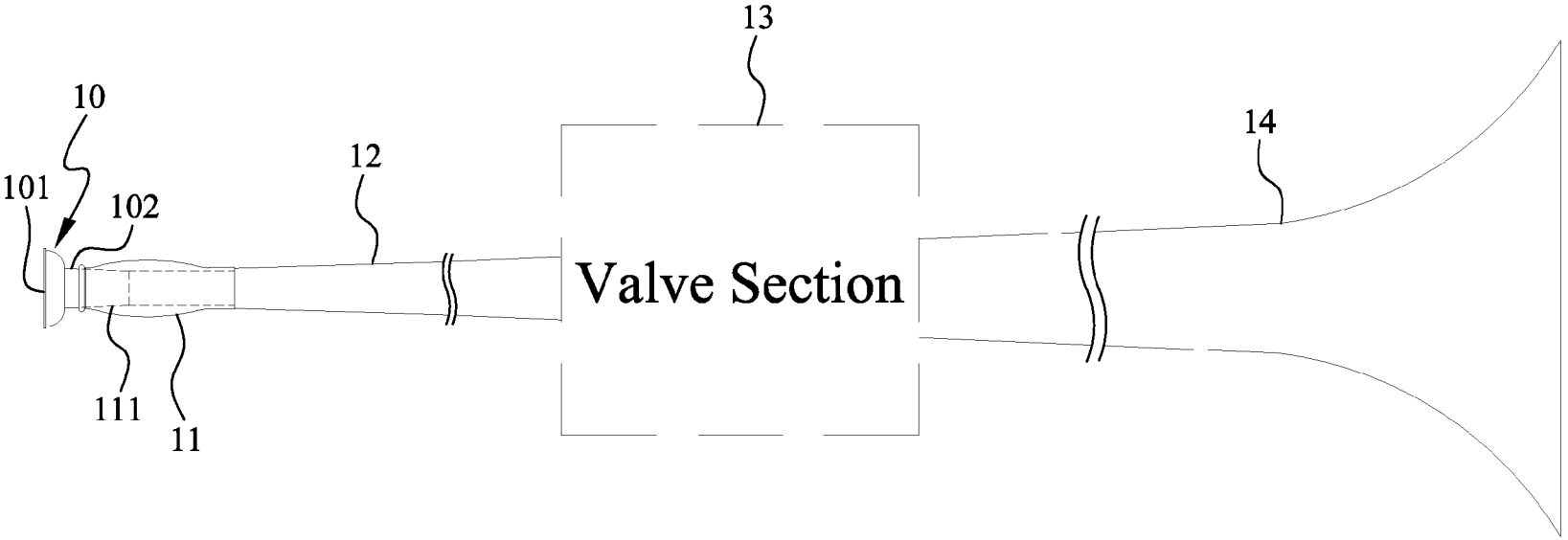
FIG. 1 (Prior Art)
FIG. 1 is a schematic view showing the manner of fitting a mouthpiece in a leadpipe of a brass instrument.

The present invention will now be described with some preferred embodiments thereof and with reference to the accompanying drawings. For the purpose of easy to understand, elements that are the same in the preferred embodiments are denoted by the same reference numerals.

Figure 2:
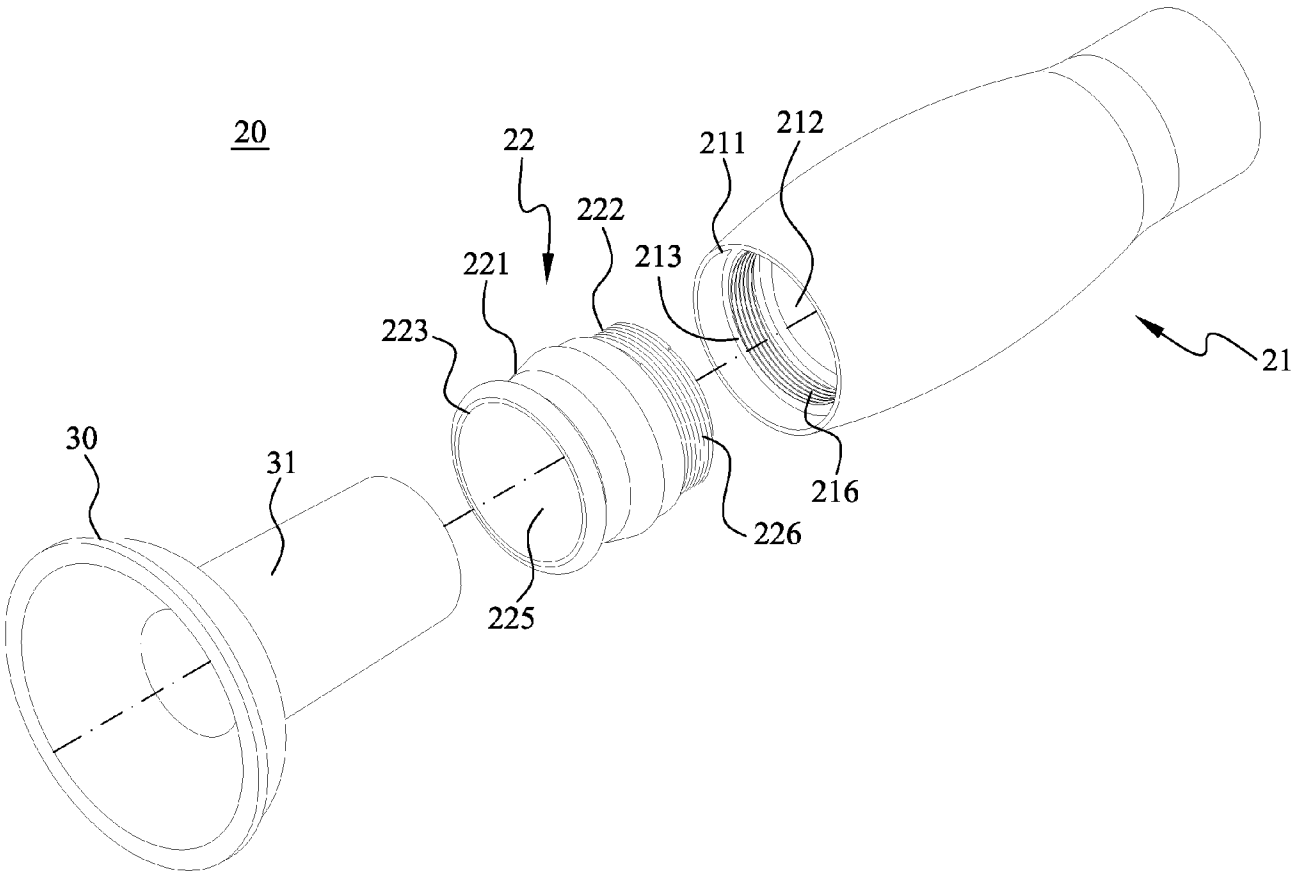
FIG. 2 is an exploded perspective view of a bore-variable leadpipe for brass instruments according to a first preferred embodiment of the present invention.
Figure 3:
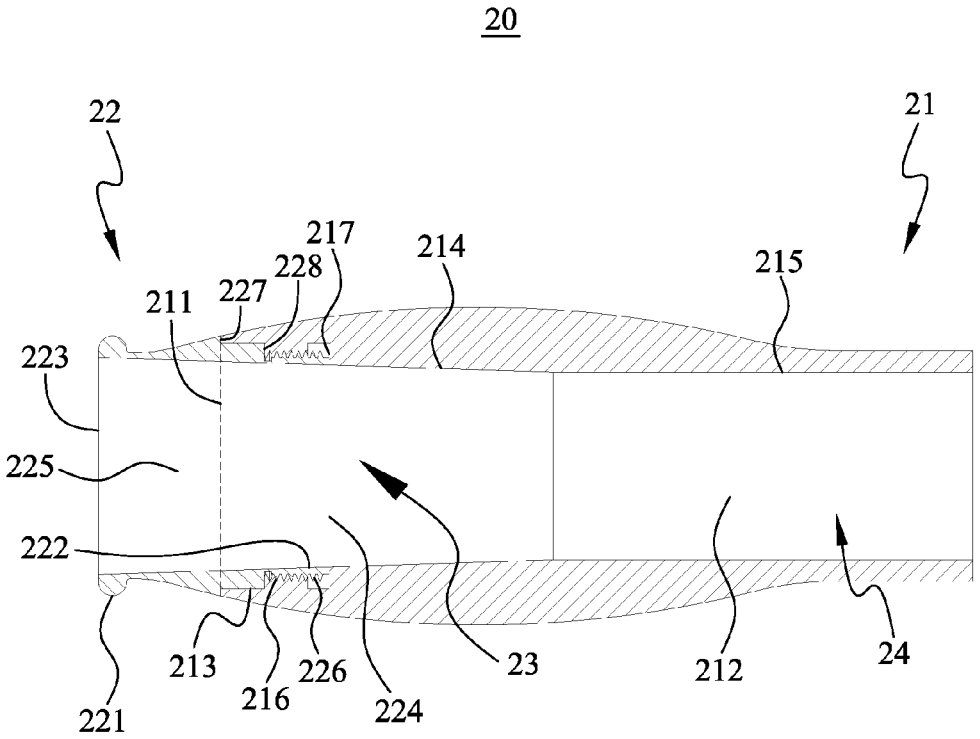
FIG. 3 is an assembled sectional view of FIG. 2.

Please refer to FIGS. 2 and 3, which are exploded perspective and assembled sectional views, respectively, of a bore-variable leadpipe for brass instruments according to a first preferred embodiment of the present invention. For the purpose of conciseness and clarity, the present invention is also briefly referred to as the bore-variable leadpipe and generally denoted by reference numeral 20 herein. As shown, in the first preferred embodiment, the bore-variable leadpipe 20 includes a mouthpiece receiver 21 connected to a brass instrument (not shown) and a mouthpiece adaptor 22 detachably assembled to the mouthpiece receiver 21. In the mouthpiece adaptor 22, a mouthpiece 30 is removably fitted for a br5ass player to play the brass instrument and produce sound. Since the technical structures of the brass instrument and the mouthpiece 30 are known in the art, they are not discussed in detail herein.

The mouthpiece receiver 21 is integrally welded to the brass instrument's tube body (not shown but generally corresponding to the mouthpipe 12 shown in FIG. 1), and has a first opening 211. The mouthpiece receiver 21 internally defines a first bore 212, which extends from the first opening 211 toward the tube body of the brass instrument. In the first bore 212, starting from the first opening 211, an assembling section 213, a tapered section 214 and an air-guiding section 215 are sequentially formed.

In the illustrated first preferred embodiment, the assembling section 213 is internally provided with female threads 216, the tapered section 214 internally defines a conical space, and the air-guiding section 215 has an inner diameter the same as that of the tube body of the brass instrument. Further, a first shoulder portion 217 is formed in the mouthpiece receiver 21 on around a junction between the assembling section 213 and the tapered section 214.

The mouthpiece adaptor 22 has a receiving end 221, through which the mouthpiece 30 is extended into the mouthpiece adaptor 22, and an opposite assembling end 222 for extending into the first bore 212 of the mouthpiece receiver 21 to engage with the assembling section 213. The receiving end 221 and the assembling end 222 define a second opening 223 and a third opening 224, respectively; and the mouthpiece adaptor 22 internally defines a second bore 225, which communicates the second opening 223 with the third opening 224.

In the first preferred embodiment, the assembling end 222 is externally provided with male threads 226 for meshing with the female threads 216, allowing the mouthpiece adaptor 22 to be screwed into and fixedly connected to the mouthpiece receiver 21 with an end surface of the assembling end 222 pressed against the first shoulder portion 217. Further, a second shoulder portion 227 and a third shoulder portion 228 are formed on around an outer surface of the mouthpiece adaptor 22 between the receiving end 221 and the assembling end 222 to axially space from each other. When the mouthpiece adaptor 22 is screwed into the mouthpiece receiver 21, the second shoulder portion 227 is pressed against an end surface of the first opening 211 and the third shoulder portion 228 is pressed against an end surface of the female threads 216.

When the mouthpiece adaptor 22 is screwed into the mouthpiece receiver 21, the outer surfaces of the mouthpiece adaptor 22 and mouthpiece receiver 21 together form a seamless curved surface, and meanwhile, the second bore 225 and the first bore 212 are aligned and communicable with each other to together form a conical passage 23 for fitly receiving the mouthpiece 30 therein as well as a cylindrical passage 24 for guiding air to the tube body of the brass instrument. The size of the second bore 225 at the third opening 224 is the same as the size of the first bore 212 at the tapered section 214, so that the aligned second bore 225 and first bore 212 can together form the conical passage 23.

Figure 4:
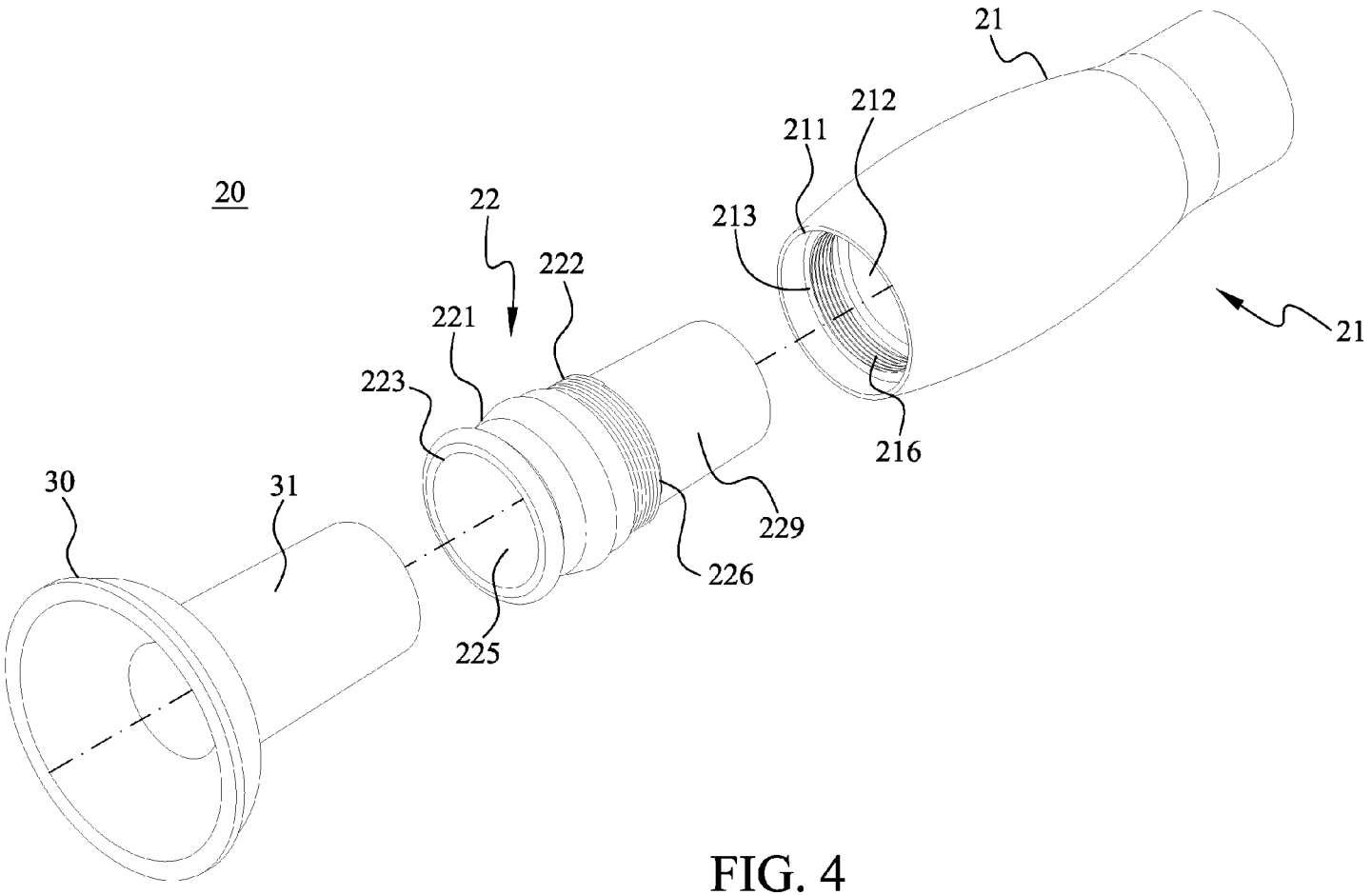
FIG. 4 is an exploded perspective view of a bore-variable leadpipe for brass instruments according to a second preferred embodiment of the present invention.
Figure 5:
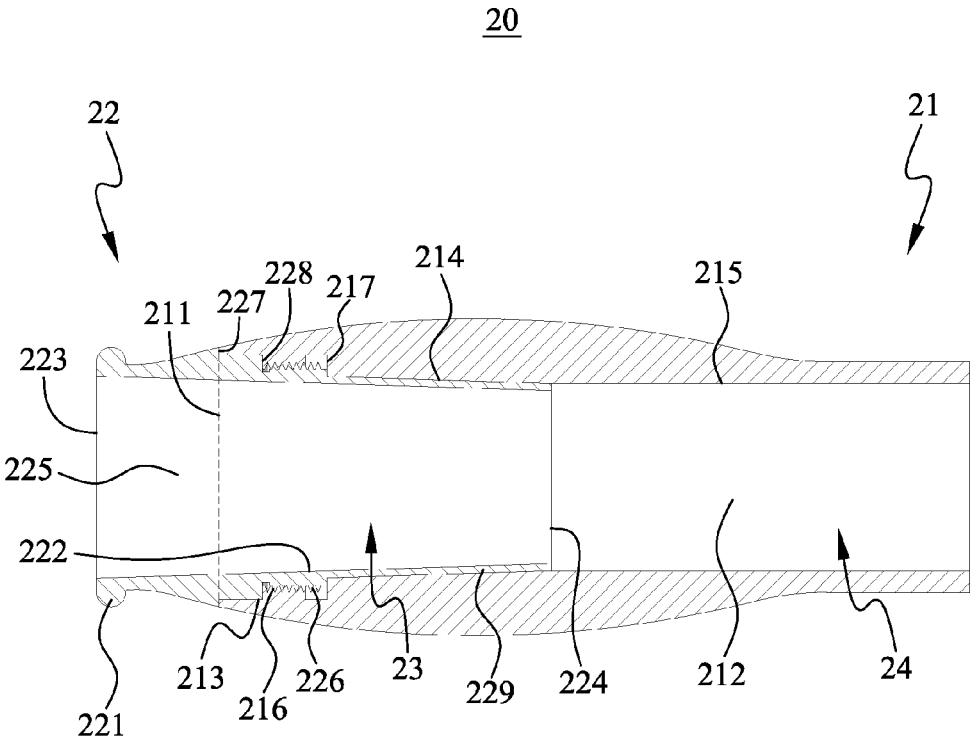
FIG. 5 is an assembled sectional view of FIG. 4.

FIGS. 4 and 5 are exploded perspective and assembled sectional views, respectively, of a bore-variable leadpipe 20 according to a second preferred embodiment of the present invention. As shown, the mouthpiece receiver 21 in the second preferred embodiment is structurally identical to that in the first preferred embodiment and is therefore not repeatedly described herein. The mouthpiece adaptor 22 in the second preferred embodiment also has a receiving end 221, through which the mouthpiece 30 is extended into the mouthpiece adaptor 22, and an assembling end 222 for extending into the first bore 212. The two ends 221, 222 have detailed structures similar to those in the first preferred embodiment.

However, the assembling end 222 in the second preferred embodiment further includes an extended tube portion 229, which is outward extended from the assembling end 222 for changing the size of the second bore 225 at the third opening 224. When the mouthpiece adaptor 22 is extended into the mouthpiece receiver 21, the extended tube portion 229 has an outer surface fitly contacting with an inner surface of the tapered section 214. The size of the third opening 224 can be changed by increasing or decreasing the length or the thickness of the extended tube portion 229.

According to the second preferred embodiment, when the mouthpiece adaptor 22 is assembled to the mouthpiece receiver 21, the second bore 225 and the first bore 212 are also communicable with each other to form a conical passage 23 for fitly receiving the mouthpiece 30 therein and a cylindrical passage 24 for guiding air to the tube body of the brass instrument. The size of the second bore 225 at the third opening 224 is the same as that of the first bore 212 at the air-guiding section 215.

Figure 6A:
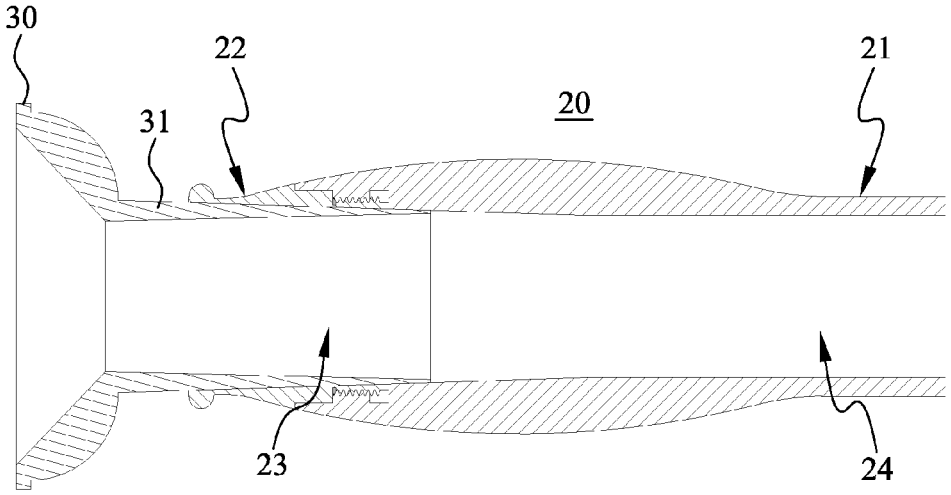
FIGS. 6A and 6B show the fitting of two differently sized mouthpieces in the leadpipes according to the first and the second preferred embodiment of the present invention.

Please refer to FIG. 6A. Since the mouthpiece 30 for an euphonium has a shank 31 larger than that of a mouthpiece for a baritone, the brass player may use the mouthpiece adaptor 22 according to the first preferred embodiment of the present invention on a brass instrument for fitting a larger mouthpiece 30, which is originally designed for an euphonium, in the conical passage 23 formed by the first bore 212 and the second bore 225.

Figure 6B:
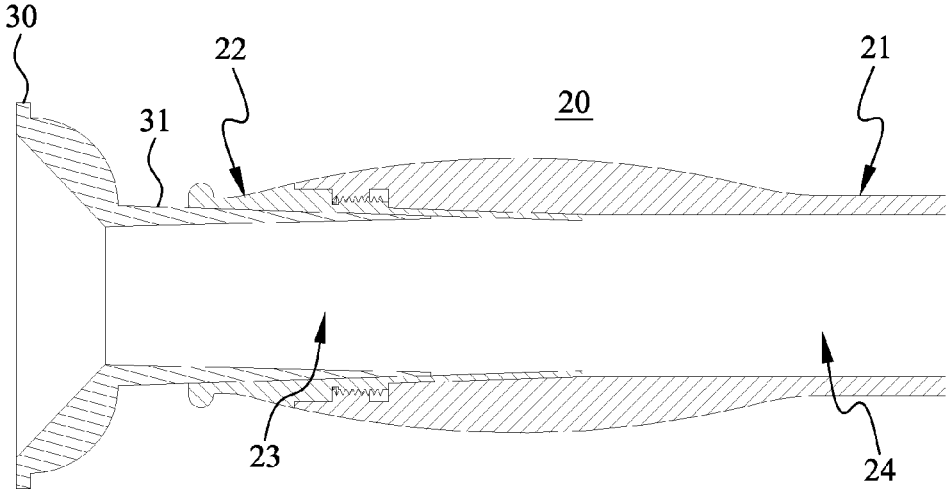

On the other hand, as shown in FIG. 6B, since the mouthpiece 30 for a baritone has a shank 31 smaller than that of a mouthpiece for an euphonium, the brass player may use the mouthpiece adaptor 22 according to the second preferred embodiment of the present invention on a brass instrument for fitting a smaller mouthpiece 30, which is originally designed for a baritone, in the conical passage 23 that is formed by the second bore 225 alone and has a reduced size.

While the use of the bore-variable leadpipe 20 of the present invention has been described with the mouthpieces for an euphonium and an baritone as shown in FIGS. 6A and 6B, it is understood the above description is illustrative and non-limiting, and the same design concept of the present invention can be applied to many other types of brass instrument for changing the bore size of the leadpipe 20. With the bore-variable leadpipe 20 according to the present invention, mouthpieces 30 of different sizes can be used with the same brass instrument. In this manner, the brass instruments are more convenient for use.

Figure 7:
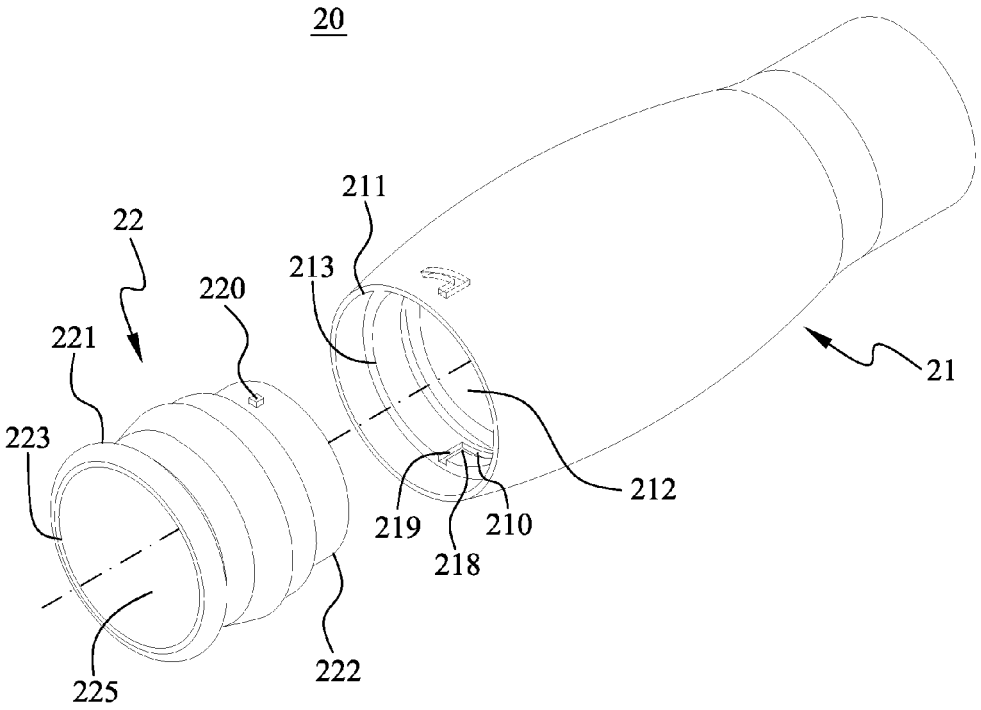
FIG. 7 is an exploded perspective view of a bore-variable leadpipe for brass instruments according to a third preferred embodiment of the present invention.
Figure 8:
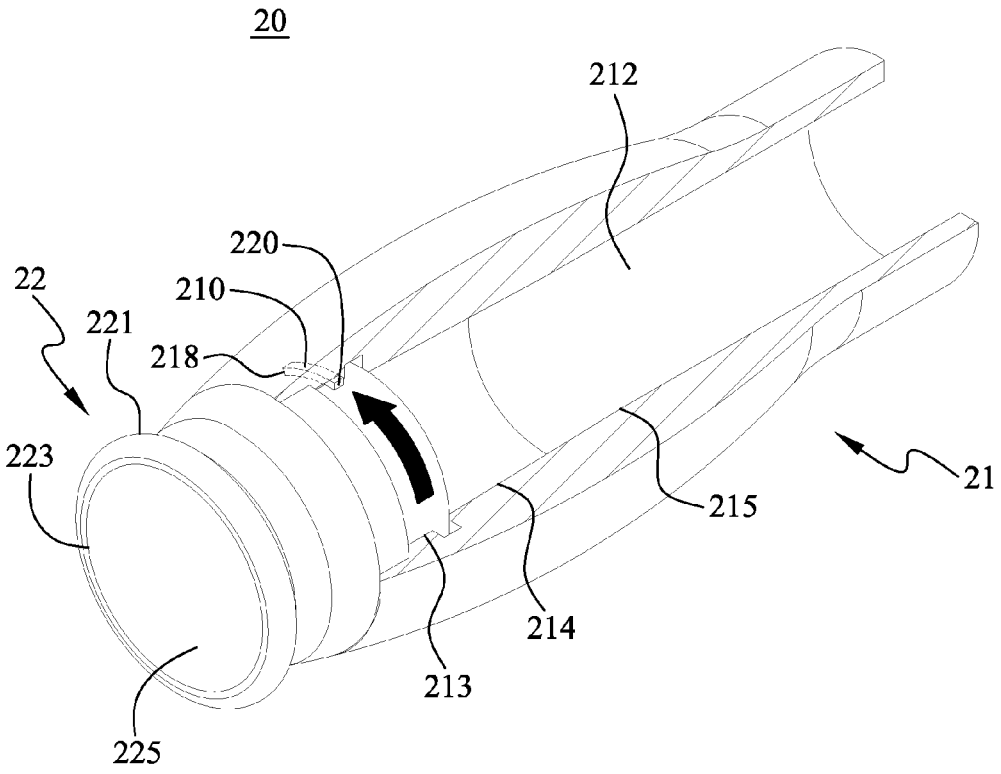
FIG. 8 is a cutaway view showing the manner in which two separate parts of the bore-variable leadpipe of FIG. 7 are assembled to each other.

FIGS. 7 and 8 are exploded perspective and cutaway views, respectively, of a bore-variable leadpipe 20 according to a third preferred embodiment of the present invention. As shown, the third preferred embodiment is generally structurally similar to the first preferred embodiment, except that, in the third preferred embodiment, the assembling section 213 of the mouthpiece receiver 21 is internally provided with at least one guide groove 218, which includes a guide section 219 and a retaining section 210, and the assembling end 222 of the mouthpiece adaptor 22 is externally provided with at least one slide block 220 corresponding to the guide groove 218.

According to the third preferred embodiment, the mouthpiece adaptor 22 is assembled to the mouthpiece receiver 21 by aligning the slide block 220 with the guide section 219, moving the slide block 220 all the way to the bottom of the guide section 219, and turning the mouthpiece adaptor 22 for the slide block 220 to locate in the retaining section 210. In this manner, the mouthpiece adaptor 22 can be easily assembled and held to the mouthpiece receiver 21.

From the above-described three preferred embodiments of the present invention, it is understood many different connection means other than screw threads can be used between the assembling end 222 of the mouthpiece adaptor 22 and the assembling section 213 of the mouthpiece receiver 21 to assemble the mouthpiece adaptor 22 to the mouthpiece receiver 21. Therefore, while the present invention has been described with some preferred embodiments thereof, it is understood that many changes and modifications in the described embodiments can be carried out without departing from the scope and the spirit of the invention that is intended to be limited only by the appended claims.

What is claimed is:

1. A bore-variable leadpipe for brass instruments, comprising:

a mouthpiece receiver being integrally formed on a tube body of a brass instrument and having a first opening; the mouthpiece receiver internally defining a first bore extending from the first opening toward the tube body; and an assembling section, a tapered section and an air-guiding section being sequentially formed in the first bore starting from the first opening; and a mouthpiece adaptor having a receiving end, through which a mouthpiece is extended into the mouthpiece adaptor, and an assembling end for extending into the first bore to engage with the assembling section and thereby assembling the mouthpiece adaptor to the mouthpiece receiver; the receiving end and the assembling end defining a second opening and a third opening, respectively; and the mouthpiece adaptor internally defining a second bore that communicates the second opening with the third opening; and the second bore and the first bore being aligned and communicable with each other when the mouthpiece adaptor is assembled to the mouthpiece receiver, and thereby forming a conical passage, in which the mouthpiece is fitted, and a cylindrical passage, via which air is guided to the tube body of the brass instrument.

2. The bore-variable leadpipe as claimed in claim 1, wherein a size of the second bore at the third opening is the same as that of the first bore at the tapered section; and wherein the mouthpiece is fixedly fitted in the conical passage that is formed by the aligned first bore and second bore.

3. The bore-variable leadpipe as claimed in claim 1, wherein the assembling end of the mouthpiece adaptor further includes an extended tube portion for changing a size of the second bore at the third opening, and the extended tube portion having an outer surface fitly contacting with an inner surface of the tapered section when the mouthpiece adaptor is extended into the first bore.

4. The bore-variable leadpipe as claimed in claim 3, wherein the size of the second bore at the third opening is the same as that of the first bore at the air-guiding section; and wherein the mouthpiece is fixedly fitted in the conical passage that is formed by the second bore alone.

5. The bore-variable leadpipe as claimed in claim 1, wherein the mouthpiece receiver further internally includes a shoulder portion formed on around a junction between the assembling section and the tapered section.

6. The bore-variable leadpipe as claimed in claim 1, wherein the mouthpiece adaptor includes at least one shoulder portion formed on around an outer surface of the mouthpiece adaptor between the receiving end and the assembling end.

7. The bore-variable leadpipe as claimed in claim 1, wherein the assembling end of the mouthpiece adaptor is screwed into the assembling section of the mouthpiece receiver.

8. The bore-variable leadpipe as claimed in claim 1, wherein the assembling end of the mouthpiece adaptor and the assembling section of the mouthpiece receiver are assembled to each other through engagement of at least one slide block with at least one corresponding guide groove.

* * * * *